US006135331A

United States Patent [19]

Davis

[11] Patent Number: 6,135,331

[45] Date of Patent: Oct. 24, 2000

[54] SNOW SKI BOOT REMOVER

[76] Inventor: Richard Maurice Davis, 10319 Country Green, San Antonio, Tex. 78240

[21] Appl. No.: 09/374,708

[22] Filed: Aug. 13, 1999

[51] Int. Cl.[7] ..... A47G 25/80

[52] U.S. Cl. ..... 223/114; 223/111

[58] Field of Search ..... 223/114, 115, 223/116, 117, 111; D2/642

[56] References Cited

U.S. PATENT DOCUMENTS

| | | | |
|---|---|---|---|
| D. 216,451 | 1/1970 | Fox | D2/642 |
| D. 274,673 | 7/1984 | McCormick | D2/642 |
| D. 320,691 | 10/1991 | Rose | D2/642 |
| 846,694 | 3/1907 | Paul | 223/114 |
| 4,226,346 | 10/1980 | Turner . | |
| 4,653,679 | 3/1987 | Lojko et al. . | |
| 4,666,070 | 5/1987 | McClung . | |
| 4,768,687 | 9/1988 | Ault . | |
| 5,050,784 | 9/1991 | Turner | 223/114 |
| 5,385,279 | 1/1995 | Dawson | 223/114 |

*Primary Examiner*—Bibhu Mohanty
*Attorney, Agent, or Firm*—John V. Stewart

[57] ABSTRACT

A ski boot remover 1 of minimal size that can be attached to a floor or alternately attached to a portable base plate 6. The remover has a horizontal engagement lip 2 and left and right mounting flanges 4. The lip 2 is spaced above the bottom of the flanges by a enough distance to admit the rear binding plate of a ski boot. When the remover is placed on a floor this distance becomes the distance from the floor to the lip. With the flanges attached to a floor, the rear binding plate 11 of a ski boot is slipped under the lip, and the foot is lifted to remove the boot. For portable use, the mounting flanges are attached to a base plate in such a way that the bottom surfaces of the flanges are coplanar with the bottom surface of the base plate. A user holds the base plate against the floor with the ball of one foot 12 while using the engagement lip to remove a ski boot from the other foot.

4 Claims, 4 Drawing Sheets

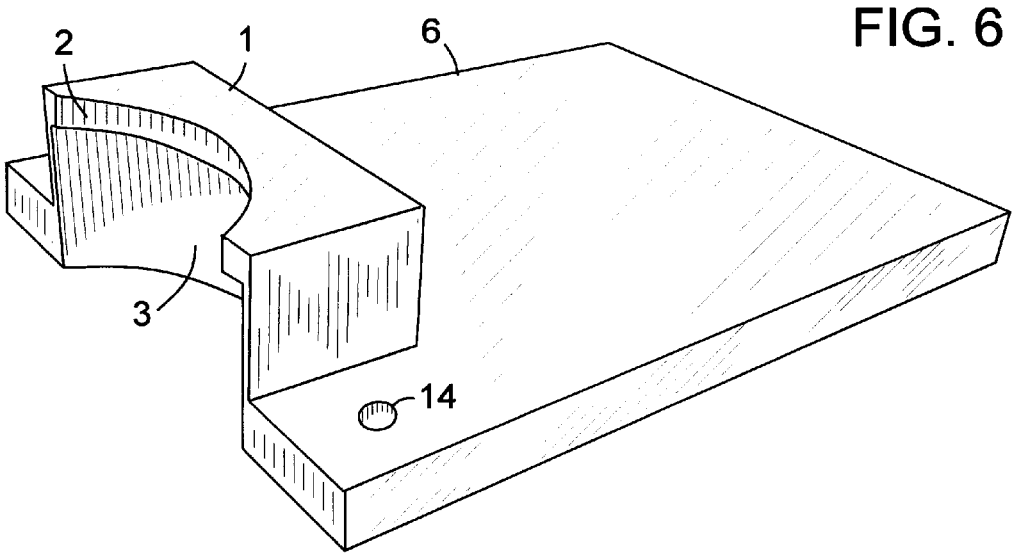
FIG. 6
FIG. 7
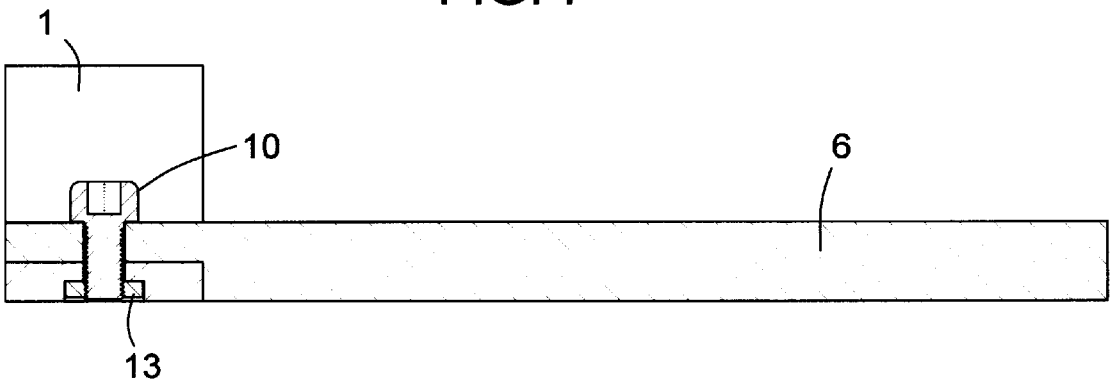

SNOW SKI BOOT REMOVER

BACKGROUND OF THE INVENTION

1. Field of the Invention

This invention is in the field of boot removal devices.

2. Description of Prior Art

U.S. Pat. No. 4,666,070 (McClung) shows a ski boot removal device with waist-high handles for stabilization, and includes a toe holding portion. It is much larger and more expensive than the present invention.

Several prior inventions relating to boot removal are not suitable for ski boots. For example, U.S. Pat. No. 4,768,687 (Ault) teaches a boot jack specifically designed to clamp the heel of rubber boots between a pair of gripping jaws. Clamping action is unnecessary for removal of ski boots. This action is inconvenient, can mar the boot heel, and is potentially unsafe. U.S. Pat. No. 4,635,679 (Lojko) shows a general boot and shoe remover. It is not specialized for ski boots, and is thus larger, less convenient, less safe for ski boots than is the present invention, and it can also mar the boot heel. U.S. Pat. No. 4,226,346 (Turner) is directed to a foldable bootjack with a positive locking device and again does not address snow ski boots.

Conventional bootjacks provide means for removing the typical western style boot. It grips the boot just above the heel on the back of the boot. The present invention is specifically designed to grip the lower rear binding plate at the heel of a snow ski boot.

SUMMARY OF THE INVENTION

The objectives of the present invention are provision of a ski boot removal device that is small, convenient, safe, and inexpensive, which can be permanently installed on a floor or portably carried, and does not mar a ski boot.

These objectives are achieved in a ski boot remover 1 of minimal size that can be attached to a floor or alternately attached to a portable base plate 6. The remover has a horizontal engagement lip 2 and left and right mounting flanges 4. The lip 2 is spaced above the bottom of the flanges by a enough distance to admit the rear binding plate of a ski boot. When the remover is placed on a floor, this distance becomes the distance from the floor to the lip. With the flanges attached to a floor, the rear binding plate 11 of a ski boot is slipped under the lip, and the foot is lifted to remove the boot. For portable use, the mounting flanges are attached to a base plate in such a way that the bottom surfaces of the flanges are coplanar with the bottom surface of the base plate. A user holds the base plate against the floor with the ball of one foot 12 while using the engagement lip to remove a ski boot from the other foot.

BRIEF DESCRIPTION OF THE DRAWINGS

FIG. 6 shows a perspective view of an integral ski boot remover and base plate.

FIG. 7 shows a sectional view of the ski boot remover attached to the base plate, taken along a vertical plane through a mounting bolt.

REFERENCE NUMBERS

Figure 1:
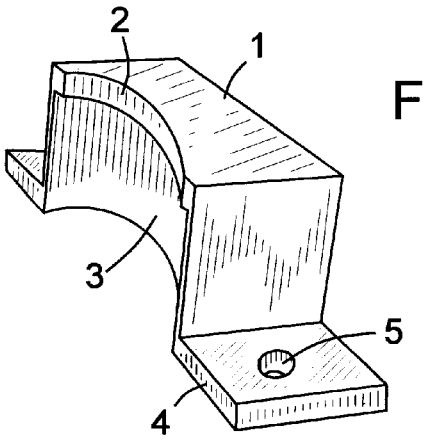
FIG. 1 shows a perspective view of the present ski boot remover.
Figure 2:
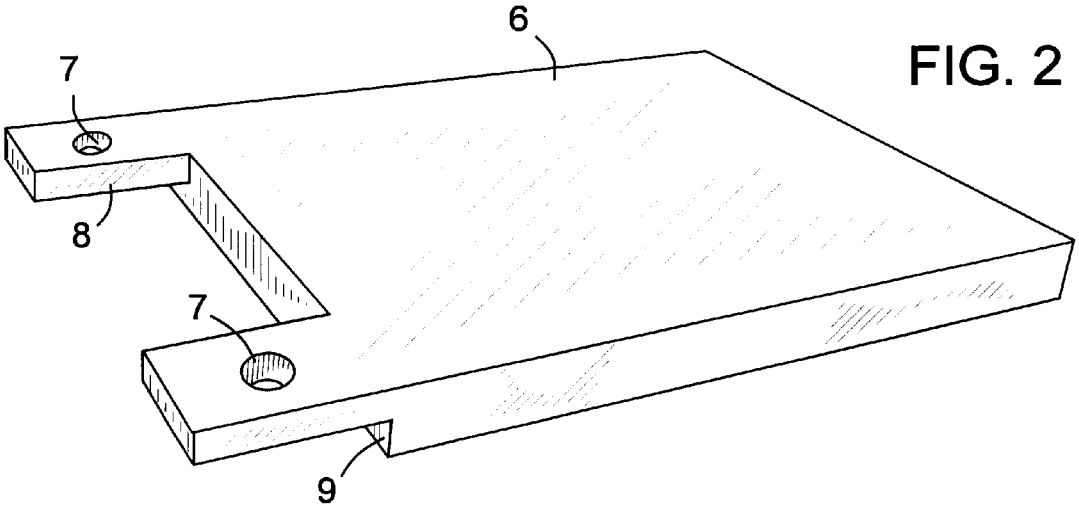
FIG. 2 shows a perspective view of the optional base plate.
Figure 3:
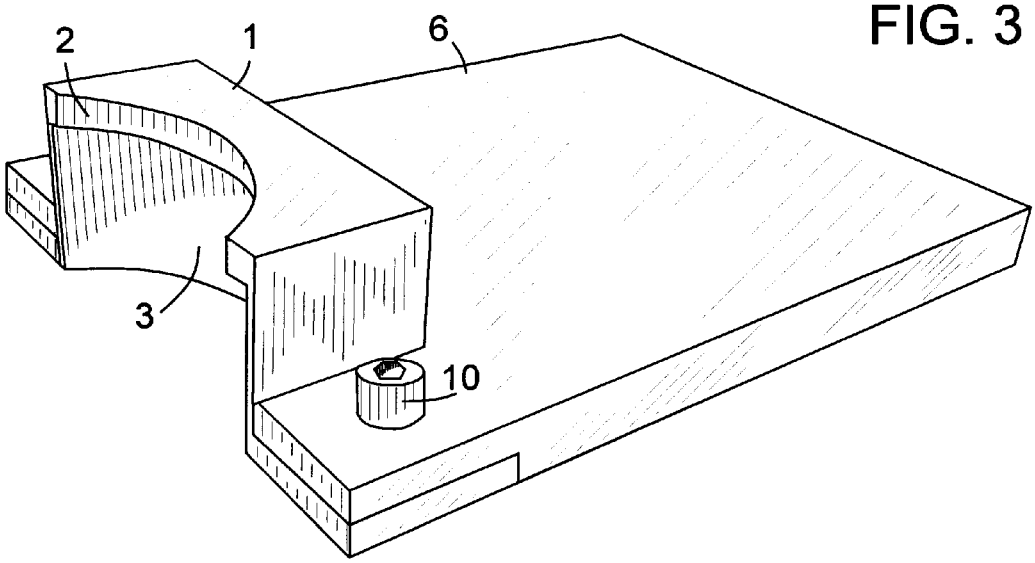
FIG. 3 shows a perspective view of the ski boot remover attached to the base plate for portable use.
Figure 4:
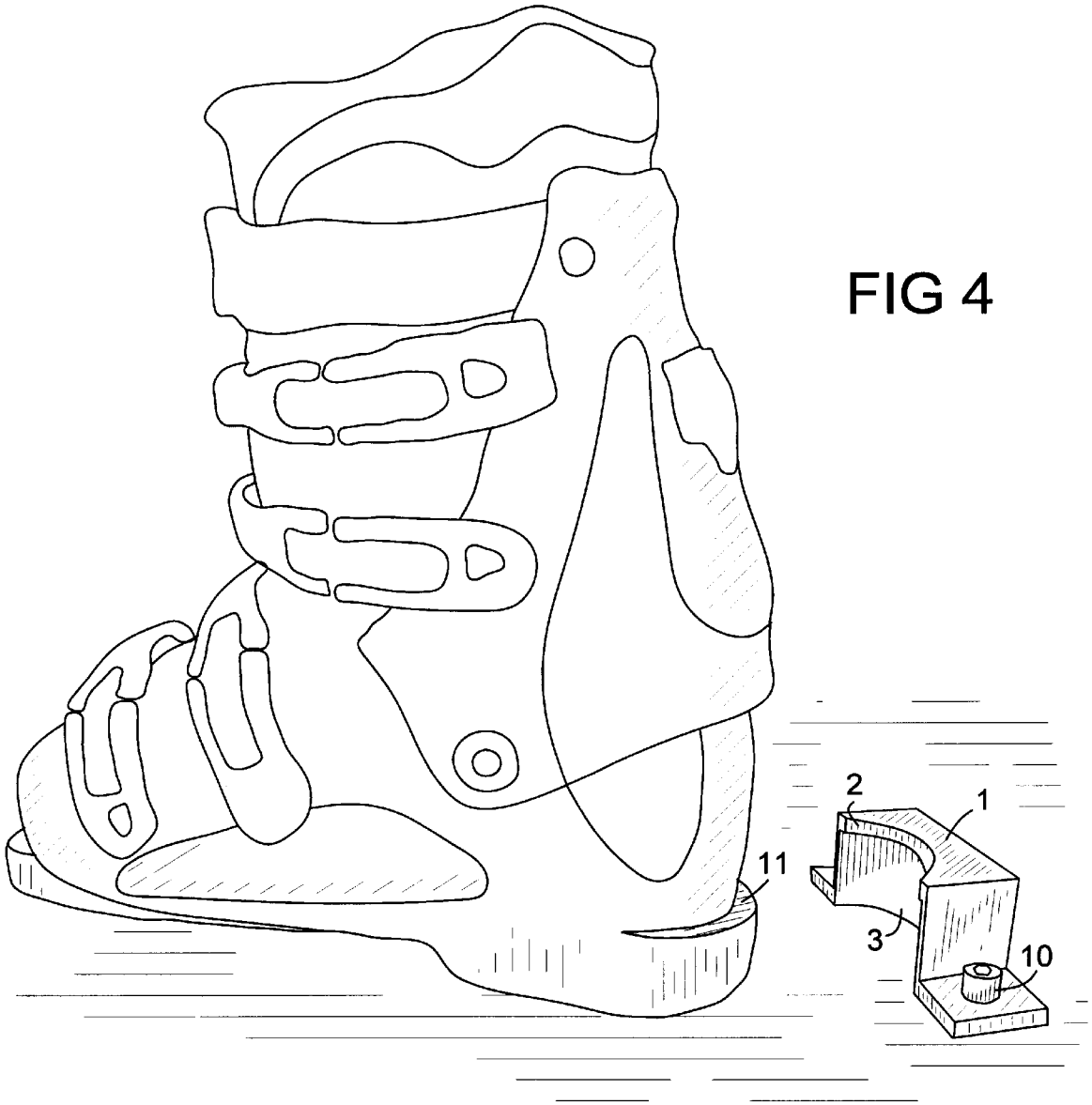
FIG. 4 shows a perspective view of the ski boot remover attached to the floor, with a ski boot positioned adjacent the ski boot remover.

1. Ski boot remover
2. Engagement lip of ski boot remover
3. Chamber
4. Mounting flange
5. Mounting hole in flange
6. Base plate
7. Mounting hole in base plate
8. Mounting projection of base plate
9. Undercut notch of base plate
10. Mounting bolt
11. Rear binding plate of ski boot
12. Toe of a ski boot
13. Nut in hexagonal chamber on bottom surface of mounting flange
14. Hole for floor mounting in integrated remover with base plate

DESCRIPTION OF THE PREFERRED EMBODIMENTS

The present snow ski boot remover 1 is a compact unit that can be either used alone by attaching it to the floor or ground for a permanent installation, or it can be attached to an optional base 6 making the unit portable. The unit may be manufactured out of wood, plastic, or metal.

A specific shape and dimensions are provided here as a suggestion for construction, although they can be modified as needed. The snow ski boot remover of FIG. 1 can be 5 inches in total width by 1.5 inches tall by 1.25 inches deep. The engagement lip 2 is about 0.25 inches thick. The bottom of the lip is about 1.25 inches above the floor. There is a clear space under the lip that is unobstructed within a radius of 1.5 inch from a center in front of the unit, approaching to about 0.25 inch from the back of the unit. The front edge of the lip is arcuate with a 1.5 inch radius approaching to about 0.5 inch from the back of the unit. A flange 4 extends about 1 inch on each side of the remover. Each flange has a bolt hole 5 for mounting the remover to a floor. A conventional expanding floor/wall anchor can be used for each bolt, or an anchor plate with two threaded holes matching the size and spacing of the mounting holes 5 in the flanges can be provided.

The optional base 6 can measure 7 inches long by 5 inches wide by 0.5 inches tall. An undercut notch 9 at one end measures 5 inches wide by 0.25 inches tall. Two mounting projections 8 overhang this notch. These projections are 3 inches apart, and overlay the flanges on the remover. A bolt hole 7 in each projection matches the mounting holes 5 on the flanges. The snow ski boot remover 1 slides into the notch 9 under the projections 8 and is secured with two 0.25×20" bolts. These bolts are preferably of allen-head design so an inexpensive hex key can be provided for mounting the remover to a floor or to the base plate. Nuts 13 (FIG. 7) are placed in hexagonal chambers on the bottom surface of the base plate to receive the bolt threads. The hexagonal chambers prevent the nuts from turning. Nuts as thin as 1/16" are practical since they do not receive any stress from boot removal. All upward stress is taken by the mounting projections 8.

Figure 5:
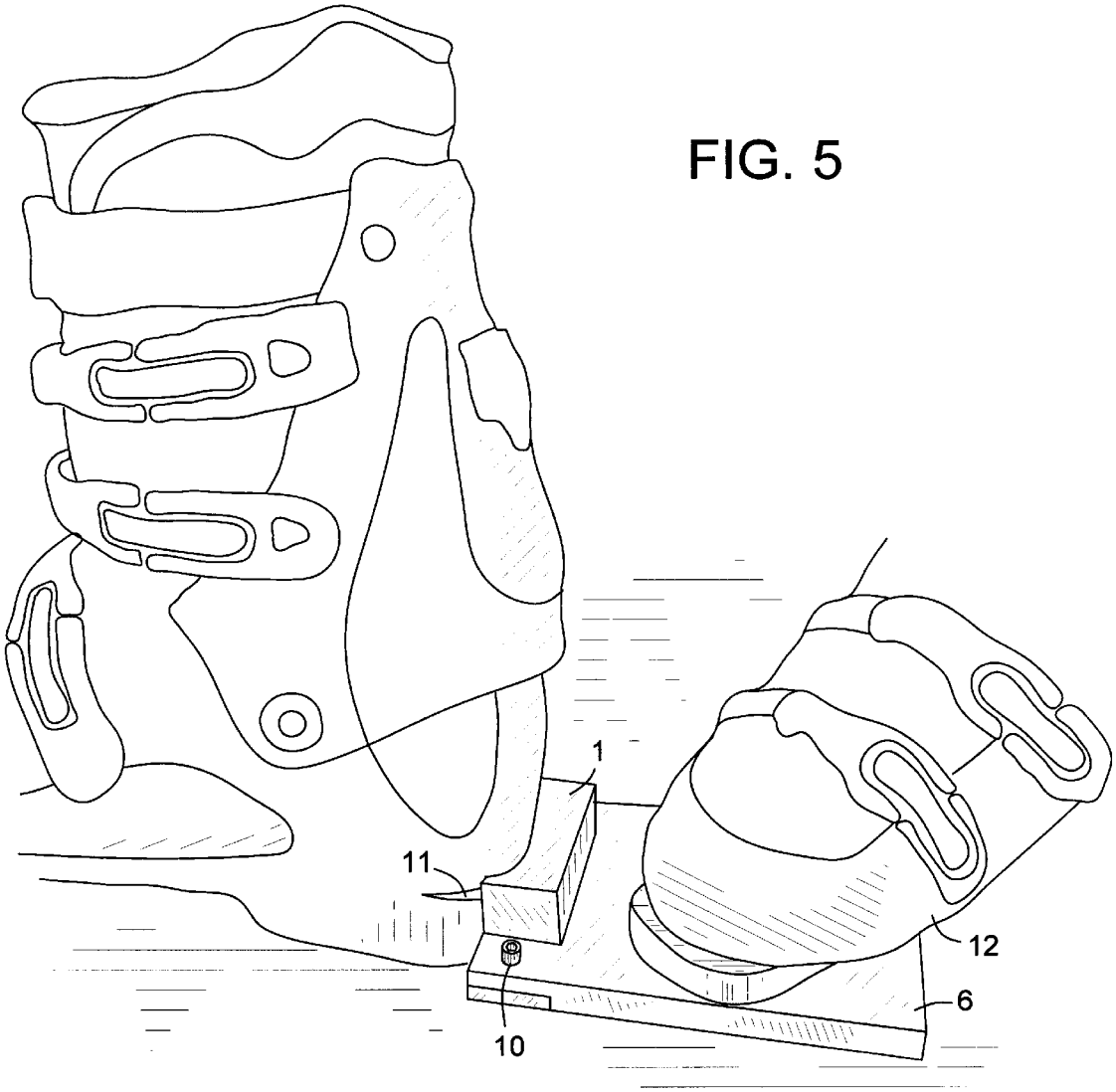
FIG. 5 shows a perspective view of the ski boot remover attached to the base plate being used to remove a boot. The left foot is holding down the base plate while the right boot is removed.

The attached base plate 6 makes the snow ski boot remover portable. As shown in FIG. 5 the base plate is held flat on the floor or ground with the ball of one foot while placing the lower rear binding plate of the snow ski boot of the other foot under the lip of the snow ski boot remover. As shown in FIG. 6, the remover and base plate can be manufactured as a single integrated unit. It preferably has bolt holes 14 as shown for optional permanent floor mounting.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A ski boot remover comprising:

an engagement lip having a bottom surface;

first and second flanges, each having a bottom surface, the two flange bottom surfaces coplanar with each other;

the engagement lip attached between the two flanges, with the bottom surface of the engagement lip spaced a predetermined distance above the bottom surface plane of the flanges, said predetermined distance chosen specifically to receive the rear binding plate of a ski boot;

means for attaching each of the flanges to a floor; and a base plate having a bottom surface and first and second projections for attaching the flanges to the base plate with the bottom surfaces of the flanges approximately coplanar with the bottom surface of the base plate;

whereby the engagement lip can be attached to a floor by means of the flanges, and the rear binding plate of a ski boot can be slipped under the engagement lip for removal of the boot from a user's foot by lifting the foot, or the base plate can be attached to the engagement lip, and a user can hold the base plate down with one foot while using the engagement lip to remove a boot from the other foot.

2. The ski boot remover of claim 1, wherein each flange has an upper surface, a vertical thickness, and a bolt hole; each projection has a bolt hole and a lower surface that overlays the upper surface of the respective flange; and the lower surface of each projection is spaced above the bottom surface of the base plate by an amount approximately equal to the thickness of the respective flange.

3. A ski boot remover comprising:

a horizontal engagement lip having left and right sides, a front edge, and a bottom surface;

a left flange and a right flange attached to the respective sides of the engagement lip;

each flange having a vertical thickness and a bottom surface, the two bottom surfaces of the flanges approximately coplanar;

the bottom surface of the engagement lip spaced a predetermined vertical distance above the plane of the bottom surfaces of the flanges, said predetermined distance chosen specifically to receive the rear binding plate of a ski boot;

each flange having a hole for receiving a vertical bolt;

a base plate having a bottom surface and a front edge;

a left projection and a right projection on the front edge of the base plate, each projection having a bottom surface and a bolt hole;

the bottom surface of each projection spaced above the plane of the bottom surface of the base plate by an amount approximately equal to the vertical thickness of the respective flange; and each projection configured to overlay the respective flange, with the holes in the projections aligned with the holes in the flanges, and with the bottom surfaces of the flanges approximately coplanar with the bottom surface of the base plate;

whereby the engagement lip can be attached to threaded anchors in a floor by means of bolts through the flanges, and the rear binding plate of a ski boot can be slipped under the engagement lip for removal of the boot from a users foot by lifting the foot, or the flanges can be bolted to the bottom surfaces of the projections, and the base plate can be placed on a floor and held down by the ball of one foot of a user while using the engagement lip to remove a ski boot from the other foot of the user.

4. The ski boot remover of claim 3 wherein the bottom surface of each flange has a prismatic chamber centered on the bolt hole for retention of a prismatic nut.

* * * * *